US007204619B2

(12) United States Patent
Sherer

(10) Patent No.: US 7,204,619 B2
(45) Date of Patent: Apr. 17, 2007

(54) BATTERY OPERATED SCONCES AND CHANDELIERS

(76) Inventor: Ronald B. Sherer, 103 S. Shaffer Dr., New Freedom, PA (US) 17349

( * ) Notice: Subject to any disclaimer, the term of this patent is extended or adjusted under 35 U.S.C. 154(b) by 61 days.

(21) Appl. No.: 10/752,250

(22) Filed: Jan. 6, 2004

(65) Prior Publication Data

US 2005/0036324 A1 Feb. 17, 2005

Related U.S. Application Data

(60) Provisional application No. 60/438,129, filed on Jan. 6, 2003.

(51) Int. Cl.
*F21V 21/00* (2006.01)

(52) U.S. Cl. ..... 362/392; 362/145; 362/190; 362/432; 362/447

(58) Field of Classification Search ..... 362/392, 362/432, 145, 147, 152, 190, 191, 441, 447
See application file for complete search history.

(56) References Cited

U.S. PATENT DOCUMENTS

| | | | | | |
|---|---|---|---|---|---|
| 4,107,770 | A * | 8/1978 | Weber | 362/405 |
| 4,713,734 | A * | 12/1987 | DeKay | 362/147 |
| 5,422,803 | A * | 6/1995 | Kilgore | 362/392 |
| 5,461,264 | A * | 10/1995 | Yang | 307/81 |
| 6,142,439 | A * | 11/2000 | Aramaki | 248/327 |
| D435,674 | S * | 12/2000 | Burks | D26/5 |
| 6,241,362 | B1 * | 6/2001 | Morrison | 362/231 |
| 6,808,297 | B2 * | 10/2004 | Jensen et al. | 362/392 |
| 6,902,293 | B2 * | 6/2005 | Tang | 362/183 |
| 2001/0033488 | A1 * | 10/2001 | Chliwnyj et al. | 362/231 |
| 2004/0037069 | A1 * | 2/2004 | Blackbourn | 362/161 |

* cited by examiner

*Primary Examiner*—Sandra O'Shea
*Assistant Examiner*—Mark Tsidulko
(74) *Attorney, Agent, or Firm*—Bartlett & Sherer; Ronald B. Sherer

(57) ABSTRACT

Battery operated sconces, battery operated chandeliers, battery operated candles and candles with unique shapes are disclosed.

3 Claims, 7 Drawing Sheets

BATTERY OPERATED SCONCES AND CHANDELIERS

This Application is based upon Provisional Application 60/438,129 filed Jan. 6, 2003 which date is claimed.

FIELD

This invention relates to wall-mounted sconces and ceiling-mounted chandeliers, and more particularly, to battery operated sconces and chandeliers which have substantially increased levels of illumination and increased times of illumination, and to electrified candles which are much more realistic in appearance.

BACKGROUND

Millions of people live in apartments or leased facilities such that, when they desire a wall mounted sconce or a ceiling mounted chandelier for soft, glowing illumination, they have only one choice. They are forced to use wax candles, and therefore tolerate the dripping wax on furniture and/or persons, as well as the extreme fire hazard. If they own the premises, they may have the second choice of paying many hundreds of dollars to install AC wiring through the existing walls and ceiling, as well as, the installation of junction boxes where they desire the sconces and/or chandeliers to be located. Obviously, neither choice is desirable. Also, prior art imitation candles have not been successful in appearing to the eye as real candles.

One of the principal reasons for this dilemma has been that battery operated candle-like illuminations have been limited to the use of one or two batteries of small size such as N, AAA or AA size because this small battery size is required in order to fit within the circumference and length of hollow plastic imitation candles. Due to these very low levels of illumination, and the very short burn times of the mini bulbs powered by such small batteries, such prior devices have been limited to use only as holiday decorations on mantles and windows. They have not been in anyway able to function as wall sconces for illuminating a dinner in the home, much less in a restaurant, and much less as a ceiling mounted chandelier where the requirements of illumination levels and the required burn times are many times that of the small batteries which may be enclosed in the imitation candles of the prior art. In addition, the use of prior art cylindrical plastic tubes to represent the candles has not made such electric candles to appear as real wax candles.

SUMMARY

The present invention solves all of these long-standing problems such that all persons may enjoy the soft and romantic light of electrified candles without the high cost of wiring or the dangers of fire and hot wax as stated above. In addition, the present invention enables both home users and commercial establishments to have the required light levels and burn times not previously possible, as well as, the visual appearance of real wax candles.

DETAILED DESCRIPTION

Figure 1:
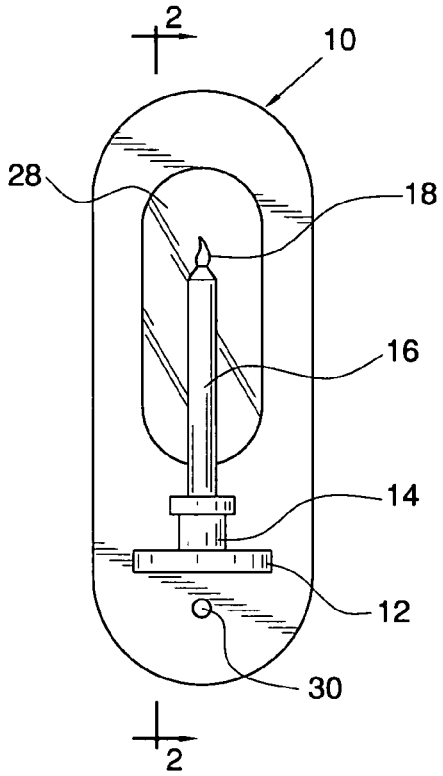
FIG. 1 is a front elevational view of one embodiment of a wall-mounted sconce of the present invention.
Figure 2:
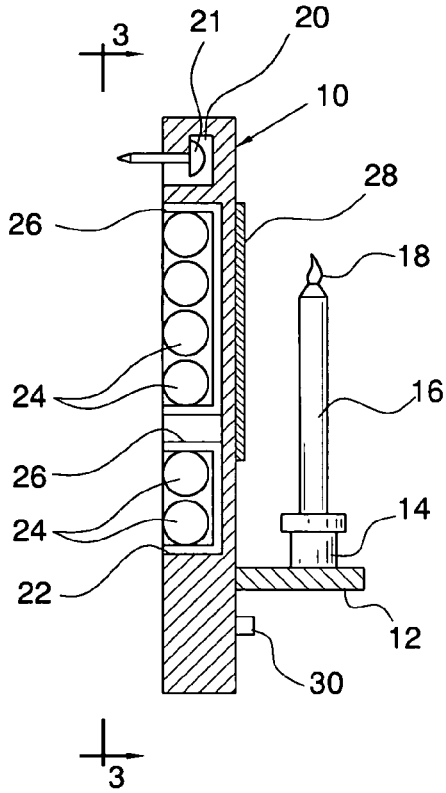
FIG. 2 is a cross-sectional view taken along view line 2—2 of FIG. 1.
Figure 3:
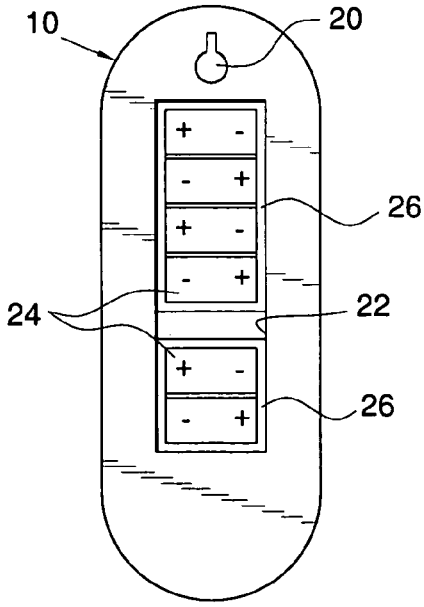
FIG. 3 is a rear elevational view taken along view line 3—3 of FIG. 2.

Referring to FIGS. 1, 2 and 3, a vertically extending wall mount 10 includes a support 12 which supports a candle base 14 and an imitation candle 16, the latter of which includes a bulb at the top. As used herein, the term "bulb" is intended to be generic to both incandescent lights as well as light emitting diodes (LED's). Wall mount 10 includes wall mounting structure for supporting the sconce on a wall. For example, a key-hole slot 20 is provided in the wall mount so as to receive the head of a nail, screw or the like 21 positioned in a wall. Alternatively, many other types of hooks and mechanical fasteners may be employed to attach the wall mount to the wall. For example, Velcro® fasteners having one piece adhered to the back of the wall mount and the other piece adhered to the wall may be used to support the sconce in an easily removable manner. Alternatively, double stick tape may be used. These types of mounting structures do no damage to the wall in any way, which is critical for persons renting or leasing premises which must not be damaged.

As shown most clearly in FIGS. 2 and 3, wall mount 10 includes a cavity 22 which is of sufficient size to receive and house one or more batteries 24. It will be understood that batteries 24 may or may not be secured in one or more battery casings 26, and that the type, voltage and number of batteries 24 may vary, as will be more fully explained hereafter. However, for purposes of illustrating one preferred embodiment, six standard flashlight batteries 24 are shown. Batteries 24 may be of various sizes including, for example, sizes N, AAA, AA, C and D, or other commercially available batteries such as rechargeable batteries, 9 volt batteries or others. It will also be understood that the batteries may be wired in series or parallel circuits as will be more fully described hereafter. The batteries may be of known types such as, for example, "Heavy Duty", "Alkaline", or "Rechargeable" types such as NiCd, or NiMH, or lead acid batteries, or other compositions such as Lithium and NiHD, or other batteries such as 9 volt transistor-type batteries whether rechargeable or not. Film-type batteries such as produced by the Polaroid Company may also be used.

Figure 4:
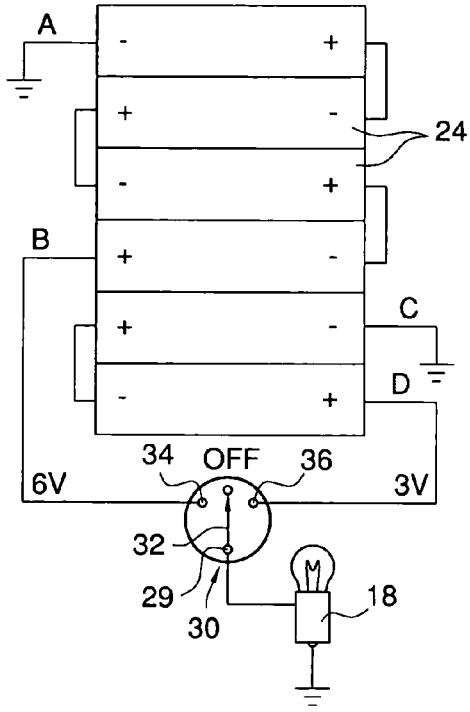
FIG. 4 is a schematic wiring diagram of the batteries, bulb and switch of the FIG. 2–3 embodiment which provides two levels of illumination.

One preferred embodiment of the batteries and circuitry is shown in FIG. 3 and the schematic circuit diagram of FIG. 4. In FIG. 4, four batteries 24 are wired in series to produce 6 volts DC between conductors A and B. The other two batteries are also wired in series, in a second circuit, so as to produce 3 volts DC between conductors C and D. Conductors A and C are grounded, as is bulb 18 which is connected to the center post 29 of a switch 30. Such ground may be by connection to a common electrical base, such as mount 10 if it is of metal, or to electrical wires or electrically conductive strips if the mount is not electrically conductive. Positive conductor B is connected to contact 34 of three-position switch 30, and positive conductor D is connected to the other switch contact 36. As a result, when contactor 32 is in the off position as illustrated, neither battery circuit is connected to bulb 18 and the bulb is not illuminated. However, when contactor 32 engages contact 34, six volts D.C. are supplied to the bulb, and when contactor 32 engages contact 36, three volts D.C. are supplied to the bulb. Alternatively, the off contact may be eliminated and the bulb may be screwed into and out of contact as the off switch.

With such dual voltage, sconce 10 may be brightly illuminated by 6 volts, such as for the appetizer and entree of a dinner, and then reduced to the lower illumination level provided by the 3 volt battery source for desserts. In this regard, it has been discovered that, with only four D size batteries and a standard incandescent flashlight bulb, the total burn time may be over 50 hours. This enables 25 two-hour dinners which more than solves the previously stated dilemma of prior imitation candles for both home and commercial restaurant use. Moreover, the burn time may be extended many times by the use of LED's and/or by batteries connected in parallel and/or by batteries of larger capacity.

Of course, the present invention is not limited to six batteries, with or without the dual voltage level as just described. As a further example, it has been discovered that a particularly preferred embodiment results when 4 batteries 24 are used for the 6 volt level, and 3 batteries 24 are used for a voltage of 4.5 volts at the second, lower level. This level of illumination has been found to more than satisfy the requirements of home use, as well as commercial restaurant use, in terms of both burn time and desired illumination which has not been previously possible.

Figure 5:
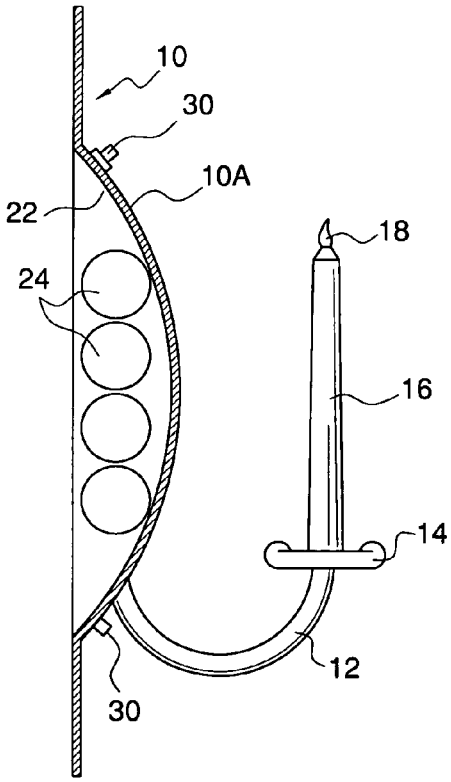
FIGS. 5 and 6 are cross-sectional views of second and third embodiments of the present invention.
Figure 6:
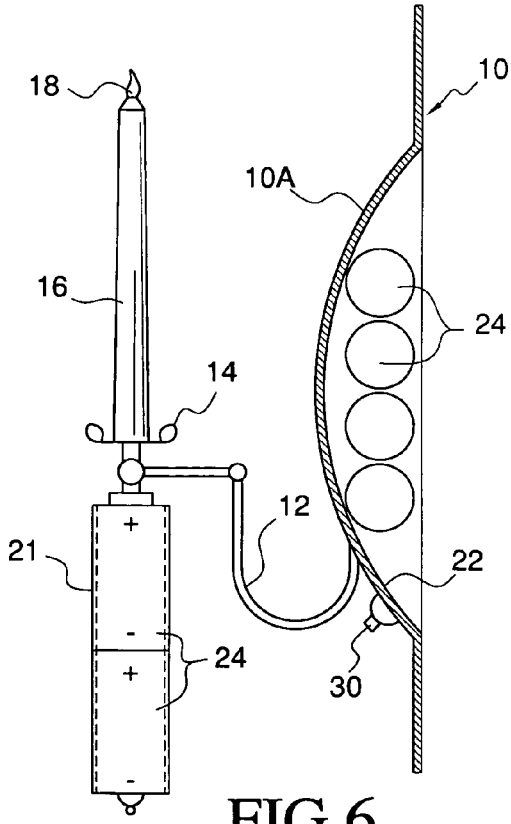

Wall mount 10 may be composed of different materials such as wood or metal, such as for example, a hollow shell of real or imitation copper or pewter, or it may be composed of a molded plastic shell with a metallized coating, all of which are schematically illustrated in FIGS. 5 and 6. Regardless of composition, in the preferred embodiments, the surface of mount 10 facing bulb 18 is preferably made highly reflective such as, for example, polished or lacquered wood, or polished or brushed metal, or metallized plastic which is reflective, or a mirror plate 28 or the like. Similarly, for example, mount 10 in the FIGS. 5 and 6 embodiments may be composed of a solid shiny metallic shell 10A, or a plastic shell with a reflective metallized coating. Of course, in all of FIGS. 1–6, it will be understood that batteries 24 are wired to bulb 18 through mount 10, support 12, base 14 and imitation candle 16 through a switch or twisting of the bulb as previously described.

Figure 7:
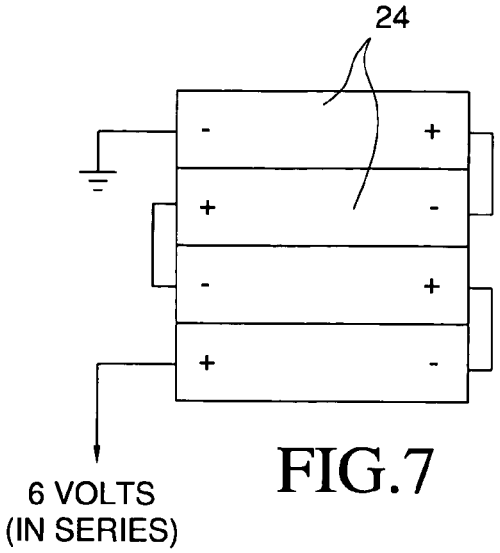
FIGS. 7 and 8 illustrate two other circuits for providing different levels of illumination.
Figure 8:
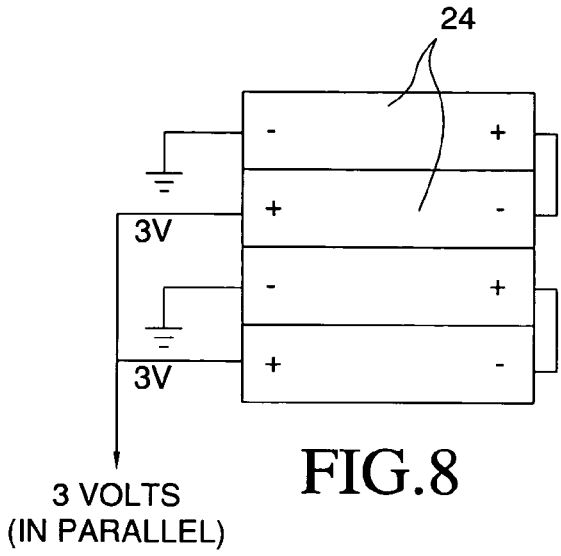

As shown in FIGS. 5 and 6, wall mounts 10 include cavities 22 which are of a size and depth such as to house two to six or more batteries. In addition, the imitation oil reservoir 21 in the FIG. 5 embodiment is preferably made hollow and of sufficient diameter and length to house one or two or more additional batteries. Thus, if the total number of batteries is six, as illustrated in the FIG. 6 as three sets of two batteries each for example, they may be wired as previously described with respect to FIG. 4. If the total number of batteries is four, as illustrated for example in the FIG. 5 embodiment, the four batteries may be connected in series to produce 6 volts as shown in FIG. 7. Alternatively, they may be connected in two pairs, with each pair in series. The two pairs are connected in parallel to produce 3 volts as shown in FIG. 8. For example, with two pairs of alkaline D size batteries in parallel, it has been discovered that the sconce will produce up to 100 hours of bright illumination with a standard incandescent flashlight bulb, and many times more with an LED.

As a result of many tests and experiments, it has been discovered that the high illumination levels of 3 and 6 volt flashlight bulbs or LED's may be somewhat more focused as a bright spot than is preferred to imitate a real candle most realistically. Many attempts have been made in the prior art to make an electric light bulb look more like a flame, and most have attempted the use of caps or the like over the bulb. None of these have been very effective in imitating a flame. More importantly, they result in reducing the amount of illumination, and also overheating the bulb thereby substantially shortening the bulb life.

Figure 9:
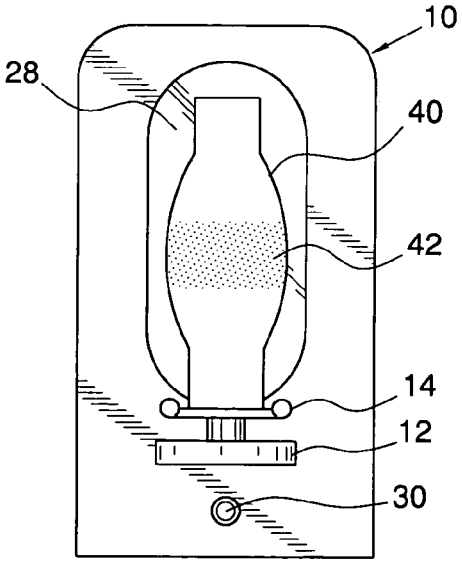
FIGS. 9 and 10 illustrate wall mounted sconces with diffusers.
Figure 10:
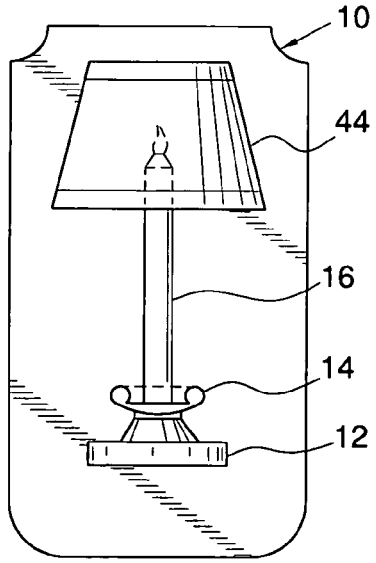

In the present invention, it has been discovered that with the relatively low voltage and current levels, the preferred solution is not to cap the bulb in any manner, but rather, to leave the bulb uncapped for maximum illumination and cooling by the ambient air. Therefore, it is preferred that the imitation candle be surrounded by a spaced apart diffuser such as hurricane glass 40 shown in FIG. 9. The hurricane glass may be entirely frosted. However, it is preferred that the glass only be frosted slightly above and below the position of the bulb as shown at 42 so that the full illumination may radiate outwardly of the glass or plastic diffuser both above and below the frosted portion of the diffuser. Alternatively, it has been discovered that the focused and concentrated light from the bulb may be softened, diffused and made more candle-like by the use of a translucent shade 44 as illustrated in FIG. 10. In each of the FIGS. 9 and 10 embodiments, the light projecting directly horizontally from the bulb is significantly softened and defused. At the same time, the amount of light shining upwardly to the ceiling and downwardly onto the table or floor is undiminished such that it provides more than sufficient light for both home use and that of commercial restaurants.

Figure 11:
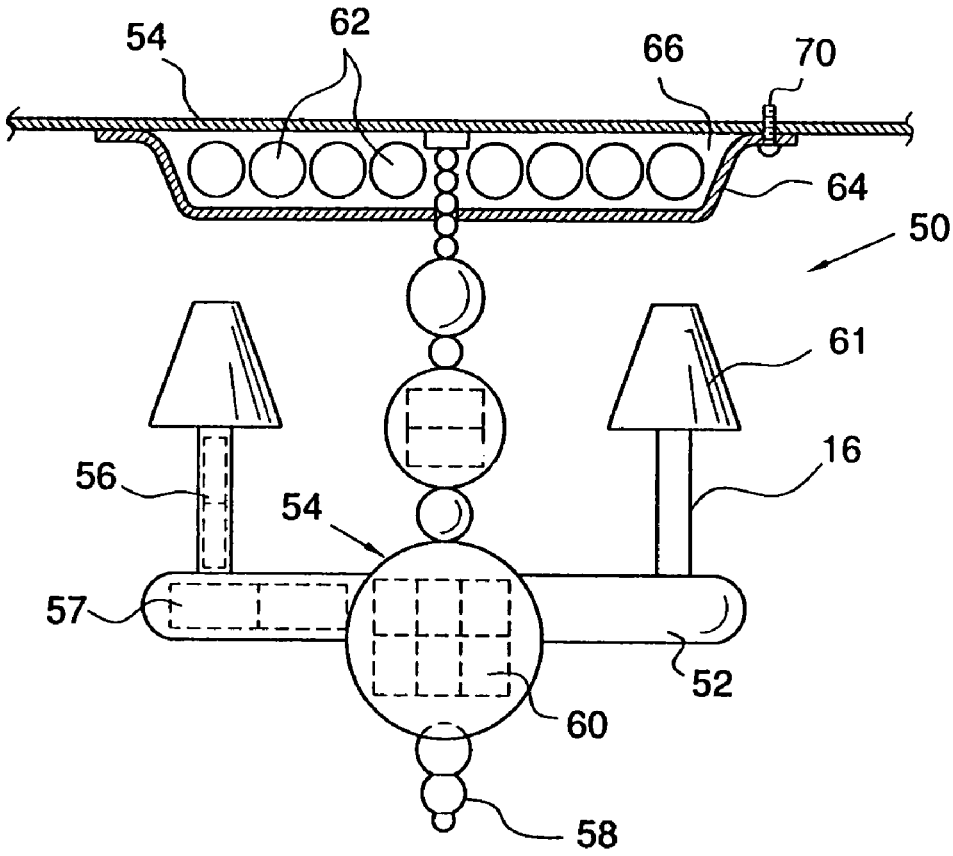
FIG. 11 schematically illustrates a ceiling mounted chandelier with internal batteries.

It has also been discovered that the unique principles of the present invention as described above may be applied to ceiling mounted chandeliers as well, not withstanding additional problems not present with sconces. By way of schematic example, FIG. 11 illustrates a chandelier 50 having a plurality of arms 52 supporting a plurality of imitation candles 16. The additional problems of greater illumination requirements and the difficulty of replacing batteries at an elevated position have been uniquely solved in the following manner. Referring to FIG. 11, chandelier 50 may be mounted directly to a ceiling 54 in the conventional manner. The chandelier preferably includes 3 to 6 or more arms 52 which extend from the central body 54 of the chandelier. At this point it will be understood that, if desired, 1 or more batteries 56 may be located in each imitation candle, and that additional batteries 57 may be located in each of arms 52. Accordingly, batteries 56 in each imitation candle are not limited to the burn time of 1 or 2 AA or AAA batteries which fit within the hollow plastic candles as in the prior art. Rather, the voltage and burn time of each candle may be multiplied many times by the batteries 57 contained in the arms of the chandelier. These batteries may be connected in series or parallel with batteries 56 in the imitation candles. As a result, the bulbs may burn much brighter, and they may burn many times longer so as to meet the requirements of a chandelier in the home or restaurant.

As further illustrated in FIG. 11, batteries 56 and 57 may be further augmented by additional batteries 60 positioned within central body 54 of the chandelier. These batteries may include, for example, two more batteries for each of arms 52 of the chandelier, thereby multiplying the burn time and the illumination level by many times. It will also be understood that shades 61 may be eliminated entirely, or replaced by globes, hurricane glasses or other diffusers to soften the light from the bulbs, and if the bulb is an LED, the batteries in the arms or in the body are more than sufficient for hundreds of hours of illumination.

As further illustrated in FIG. 11, the above-described batteries in the chandelier may be further augmented by, or entirely replaced by, batteries 62. These batteries may be positioned in and supported by a medallion 64 having a hollow cavity 66. The medallion 64 may be supported from the ceiling 54 by conventional means 70 such as screws, Molly Bolts or other fasteners. The chandelier 50 may be supported directly from ceiling 54, as shown, or by medallion 64 connected to the ceiling. Of course, it will be understood that wires (not shown) electrically connect batteries 62 to the bulbs through a switch such as switch 30 shown in the previous embodiments. Preferably, the medallion has a diameter in the order of 6 to 18 inches or more and a vertical cavity depth of one or more inches. This is more than sufficient to house a large plurality of batteries for operating the bulbs for over 100 hours, and substantially longer if the bulbs are LED's.

Figure 12:
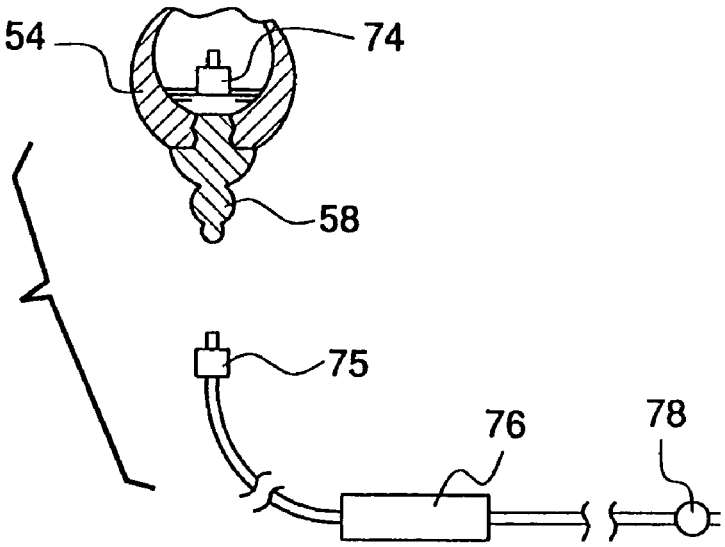
FIG. 12 schematically illustrates a removable finial on the chandelier and a recharging system for recharging the batteries.
Figure 13:
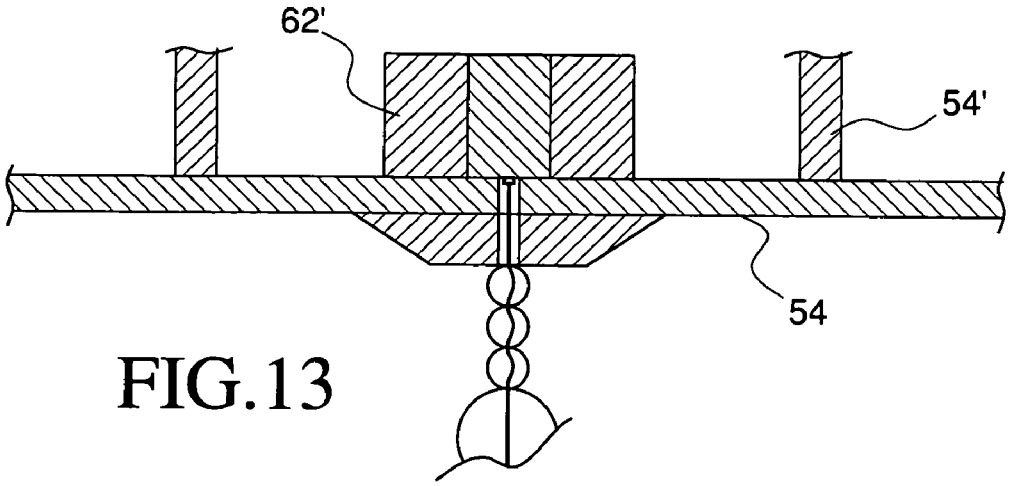
FIG. 13 schematically illustrates batteries for a chandelier being positioned above a ceiling.

Since the ceiling location of a chandelier is more difficult to reach than a wall mounted sconce, the preferred embodiment of the present invention utilizes batteries of the alkaline, or preferably, of the true rechargeable type such as NiCD, lead acid or NiMH type, for example. Rechargeable batteries are preferred so as to eliminate the need to change batteries in the elevated position of chandeliers. As shown in FIG. 12, the batteries in the chandelier and/or the medallion may be connected to a female electrical plug 74 such as a standard co-axial plug for example. Thus, the batteries may be recharged by a commercially available recharger 76 and male plug 75; charger 76 being connected to a common AC 115v or 220v source (not shown) by plug 78. For example, finial 58 may be threaded into body 54, or the finial may be simply hinged so as to expose connector 74 for such recharging. Alternatively, it will be understood that plug 74 may be located in other portions of the chandelier such as, for example, in the end of one of arms 52 or in the body of the chandelier, or in medallion 64. Also, as shown in FIG. 13, it has been discovered that at least some of the batteries, such as batteries 62', may be positioned above the ceiling 54 and rafters 54'. For example, it is preferred that batteries 62' be of the truly rechargeable type, and preferably of the long lasting type such as lead acid batteries, or commercial grade rechargeable batteries currently sold for use in power tools and the like.

Figure 14:
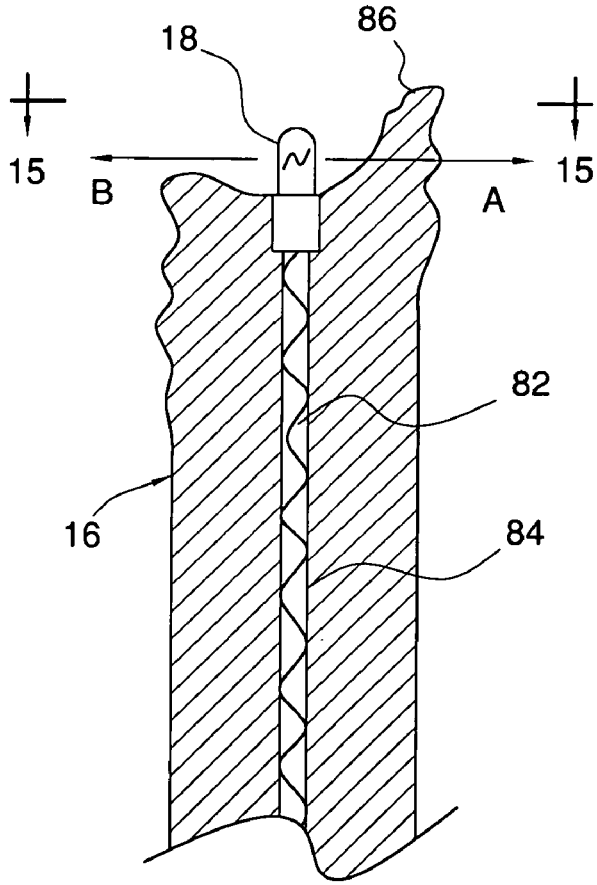
FIGS. 14 and 15 schematically illustrate electrified real wax candles.
Figure 15:
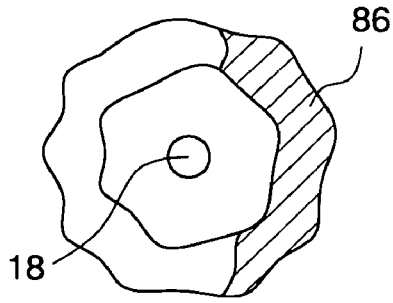

In addition, it has been discovered that, instead of plastic imitation candles 16, real wax candles may be used such that the light of the incandescent bulb or LED radiates through and glows at the upper portion of the wax candle. The use of real wax candles greatly increases the image of the electric candle as being a real burning candle. As shown in FIG. 14, the incandescent bulb or LED 18 is connected through wires 82 in passage 84 in a real wax candle 16". The battery source may be located in any of the locations in the sconce and/or chandelier previously described. As shown in FIGS. 14 and 15, it has also been discovered that either bright light or diffused light may be produced by forming the top of the candle with an elevated portion 86 which is higher than the other surrounding portions of the candle; i.e., just as real candles tend to burn unevenly from one side or the other. As a result, the user may rotate the candle about its vertical axis so as to have diffused light passing through elevated portion 86 into the room as shown by arrow A, or bright light passing into the room, or reflected against the sconce, as shown by arrow B. In between positions may be used as desired, and if the bright light shown by arrow B is desired to shine into the room, a diffuser glass or shade as shown in FIGS. 9 and 10 may be used if desired.

Figure 16:
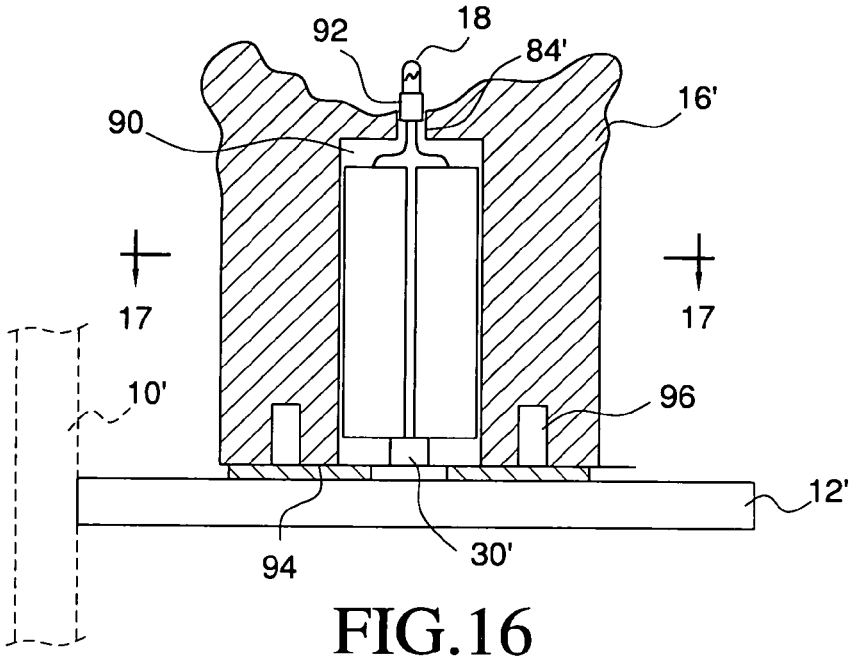
FIGS. 16, 16A and 17 schematically illustrate real wax candles electrified by batteries contained within the wax candle.
Figure 16A:
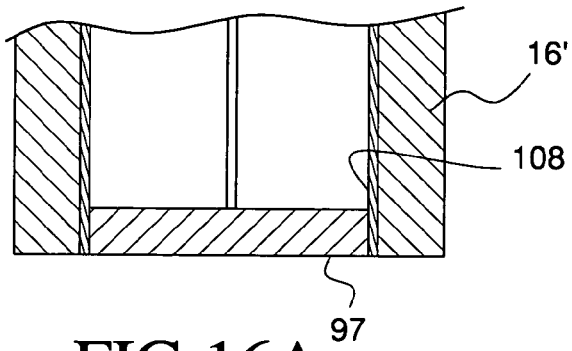
Figure 17:
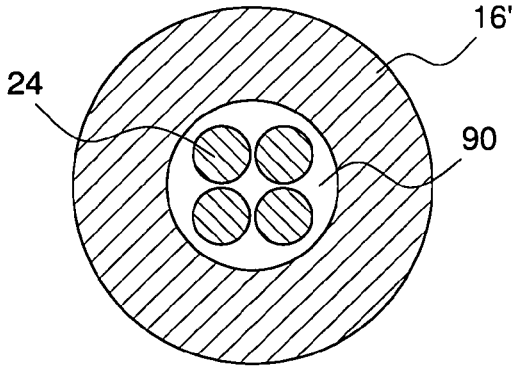

It has also been discovered that the battery or batteries may be located within the real wax candle itself as schematically illustrated in FIGS. 16 and 17. In this embodiment, real wax candle 16' has a cavity 90 for containing batteries. For example, one or more AAA or AA batteries, or one or more C or D size batteries may be used. The wires from the batteries extend up through passage 84' to bulb socket 92, or directly to an LED if desired. In this manner, electrified real wax candle 16' may be turned on by rotating the bulb in socket 92 to make contact, or if a non-rotatable bulb is used, such as an LED, then a switch 30' may be employed to turn the bulb on and off as desired. When using a switch, the battery pack may be wired as previously described so as to supply two different voltages to the bulb such as, for example, 3 or 6 volts or more volts as desired for the particular application in the home or restaurant. The batteries may be retained with the cavity 90 of the wax candle in many ways, one of which is illustrated as comprising a bottom plate 94 removably secured to the bottom of the candle by friction pins or screws 96 or the like. Thus, the batteries may be replaced by simply removing plate 94 and inserting new batteries. Alternatively, the bottom may be removably closed by a friction plug 97, and the plug may engage the candle wall directly, or may engage a cylindrical liner 95 as illustrated in FIG. 16A.

Of course, the embodiment of the invention involving batteries within a real wax candle is not in any way limited to use with either sconces or chandeliers. That is, the real wax candle with self-contained batteries may be used wherever desired. For example, on tables, shelves or any reasonably flat surface in the home or commercial establishment, with any desired voltage and with a very realistic glow through the upper portion of the real wax candle. At the same time, one preferred embodiment is to mount candle 16' on a support 12' connected to the wall mount 10' of a sconce as previously described. It will also be apparent that the upper portion of wax candle 16' may have one portion higher and other portions lower, as described with respect to the FIG. 14 embodiment. Alternatively, all upper portions of the candle may be above the bulb as shown in FIG. 16 so that the candle glows through the wax realistically in all directions.

Figure 18:
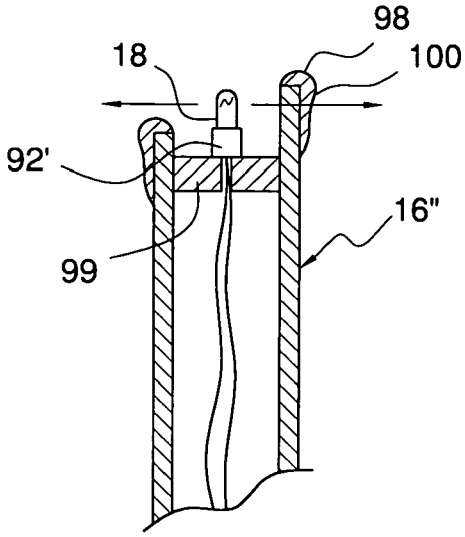
FIG. 18 schematically illustrates a hollow plastic candle with at least one raised portion which glows like a real candle as the light is diffused.

Although the use of real wax candles in the embodiments illustrated in FIGS. 14, 15 and 16 are substantially preferred in order to achieve maximum realism, cost factors may favor the use of candles made of extruded or molded plastic as illustrated schematically in FIG. 18. In this embodiment, the bulb may shine through one raised portion 98 of plastic candle 16" and produce a glow at the top of the plastic candle similar to that of a real wax candle. Alternatively, the bulb may be positioned below all or most of the top portions of the candle as previously illustrated with respect to FIG. 16. The top of the plastic candle may also be topped with real wax as shown at 100. It will be understood that the bulb may be mounted in the plastic candle in various ways. For example, a bulb mount 92' and a support 99 may be provided such as illustrated for purposes of example in FIG. 18, or without a bulb mount 92' if the bulb is an integrally wired LED.

Figure 19:
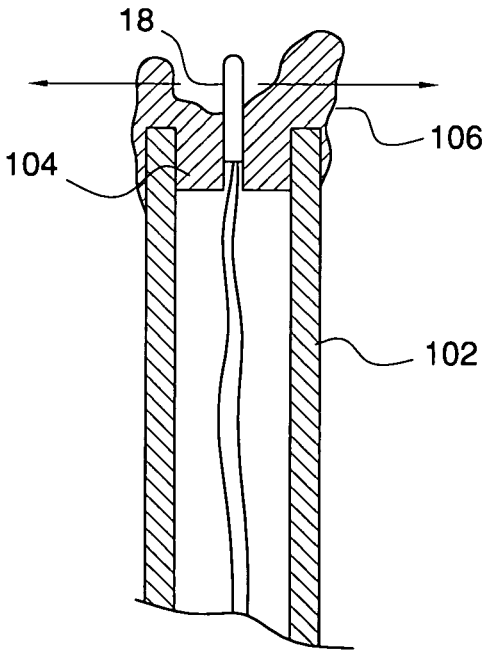
FIG. 19 schematically illustrates a hybrid plastic and wax candle.

As a cost compromise between the more realistic effects of a real wax candle versus a lower cost plastic candle, the present invention includes a hybrid plastic/wax candle as illustrated in FIG. 19. In this embodiment, the lower portion 102 of the candle is formed of plastic, and the upper portion, which glows like a more realistic candle, comprises a plug of real wax 104. The plug of wax may be held in the plastic cylinder by a force-fit as illustrated, or the plug and the upper plastic portion may be threaded. While the separation line between the wax and plastic may be made almost unnoticeable by proper fitting and color match, it is preferred that wax plug 104 includes drippings 106, or that wax be dripped over the top of the candle and the separation line between the plastic and the wax plug as illustrated in FIG. 19. While bulb 18 is shown as being an LED, an incandescent bulb with a bulb support may be used as illustrated in the other embodiments.

From the foregoing descriptions of a few embodiments of the present invention, it will be apparent that many modifications and variations of the invention will become apparent to those skilled in the art. Accordingly, it is to be understood that the foregoing descriptions are intended to be illustrative rather than exhaustive of the principles of the invention, and not in any way limiting of the invention, and that the scope of the invention is not intended to be defined or limited other than as set forth in the following claims interpreted under the doctrine of equivalents.

What is claimed is:

1. A wall sconce comprising:

(a) a wall mount;

(b) means for mounting said wall mount on a wall;

(c) a cavity in said wall mount;

(d) an electric candle supported by said mount;

(e) at least one battery in said cavity an said wall mount;

(f) electrical conductive means connecting said at least one battery to said electrified candle;

(g) said electrified candle being composed of a plastic portion and a wax portion; and (h) said wax portion has raised and lower portions for passing light at different light levels.

2. A wail sconce comprising:

(a) a wall mount;

(b) means for mounting said wall mount on a wall;

(c) a cavity in said wall mount;

(d) an electric candle supported by said mount;

(e) at least one battery in said cavity in said wall mount;

(f) electrical conductive means connecting said at least one battery to said electrified candle;

(g) said electrified candle being composed of a plastic portion and a wax portion; and (h) said plastic portion includes upper portions of different vertical height.

3. A wall sconce comprising:

(a) a wall mount;

(b) means for mounting said wall mount on a wall;

(c) a cavity in said wall mount;

(d) an electric candle supported by said mount;

(e) at least one battery in said cavity in said wall mount;

(f) electrical conductive means connecting said at least one battery to said electrified candle;

(g) said electrified candle including an upper end and said upper end includes vertically higher and lower relative portions whereby diffused light passes through said higher portion and non-diffused light passes over said lower portion; and (h) wherein said electrified candle is rotatable about its vertical axis for passing light through said higher and lower portions with different light intensities.

* * * * *